United States Patent [19]

Collier et al.

[11] Patent Number: 4,820,188

[45] Date of Patent: Apr. 11, 1989

[54] METAL SHELL ELECTRICAL CONNECTOR AND SUBASSEMBLY THEREFOR

[75] Inventors: William H. Collier, Iselin, N.J.; Matthew J. Fadule, Easton; James S. Dunn, Doylestown, both of Pa.

[73] Assignee: Thomas & Betts Corporation, Bridgewater, N.J.

[21] Appl. No.: 174,258

[22] Filed: Mar. 28, 1988

[51] Int. Cl.[4] ..... H01R 4/24

[52] U.S. Cl. ..... 439/395; 439/417

[58] Field of Search ..... 439/389–425

[56] References Cited

U.S. PATENT DOCUMENTS

| | | | |
|---|---|---|---|
| 3,990,767 | 11/1976 | Narozny | 339/198 |
| 4,099,816 | 7/1978 | Bittner et al. | 339/17 |
| 4,241,970 | 12/1980 | Rider, Jr. et al. | 339/99 |
| 4,431,248 | 2/1984 | Huntley et al. | 339/99 |
| 4,470,655 | 9/1984 | Kalka et al. | 339/99 |
| 4,538,873 | 9/1985 | Worth | 339/99 |
| 4,556,272 | 12/1985 | Briones | 339/99 |
| 4,560,226 | 12/1985 | Dennis | 339/99 |
| 4,703,990 | 11/1987 | Assmann et al. | 439/404 |
| 4,725,243 | 2/1988 | Pretchel et al. | 439/395 |

OTHER PUBLICATIONS

Four (4) photos of Amphenol Device.

Thomas & Betts, Electronics Division, "Mass Termination IDC System", Cat. No. IDC-3, 1987, front cover, back cover, pp. 50–52, 64–70.

*Primary Examiner*—Joseph H. McGlynn

*Attorney, Agent, or Firm*—Robert M. Rodrick; Salvatore J. Abbruzzese

[57] ABSTRACT

An electrical connector for insulation displacment connection to conductors of a flat multiconductor cable includes an elongate insulative housing defining a cavity therein for latchably receiving a pair of insert subassemblies. During manufacture, each subassembly comprises a plurality of insulation displacement contacts having two, spaced tines defining therebetween a conductor receiving slot. Each contact is joined between adjacent tines by a carrier web to thereby form a joined array of contacts. An elongate insulative insert supports the contacts in each subassembly. Each insert has an upper surface defining a cable support surface from which the IDC ends project. A plurality of grooves extends into the insert upper surface, each groove being in substantial registry with a carrier web joining the tines. The grooves each have a bottom surface spaced from the carrier web. Such construction permits use of a suitable severing tool to remove the carrier webs in a ready manner with minimal wear on the tool. Subsequent to carrier web removal, the subassemblies are suitably secured to the connector housing.

13 Claims, 5 Drawing Sheets

FIG. 8
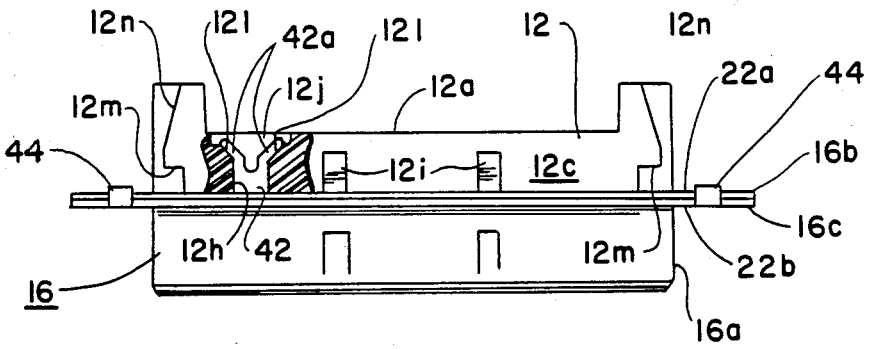
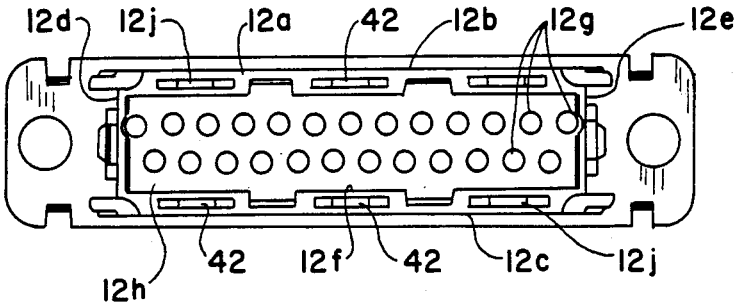
FIG. 9

METAL SHELL ELECTRICAL CONNECTOR AND SUBASSEMBLY THEREFOR

FIELD OF THE INVENTION

The present invention relates to an electrical connector and, more particularly, to an electrical connector of the insulation displacement contact type and which includes contact subassemblies specifically configured for ease of manufacture.

BACKGROUND OF THE INVENTION

Electrical connectors of the type for mass termination to flat multiconductor ribbon cable have been in use particularly in the data communications industry for some time. Such mass termination electrical connectors typically include insulation displacement contacts (IDC) by which conductors contained in a flat multiconductor ribbon cable are commonly terminated without need for stripping the conductors from the insulation. One example of such a connector is U.S. Pat. No. 3,990,767 (Narozny), wherein all the contacts are formed initially to have an identical configuration for manufacturing purposes and which are later bent during assembly to achieve a pitch transition. In the Narzony connector, electrical interconnection is made from a flat multiconductor cable wherein conductors are spaced at 0.050 inch to a standard D-face configuration wherein the pins or sockets are located at 0.0545 inch.

Demands in the communications industry have been placed upon the electrical connector manufacturers for adding protection against electromagnetic and radio frequency interference (EMI/RFI), smaller sizes in an effort to conform to higher density packaging and lower manufacturing costs. One example of an electrical connector having insulation displacement contacts, as well as a metal shell for electrical protection is U.S. Pat. No. 4,470,655 Kalka, et al.). As in the Narozny patent, the Kalka, et al. device achieves pitch transition by the use of identical contact elements having a central deformable strap portion that is bent to achieve the desired pitch transition. In another example of an electrical connector of the IDC type, albeit without a metal shell, U.S. Pat. No. 4,241,970 (Rider, Jr., et al.) discloses an electrical connector having IDC contacts that are formed during manufacture to have the desired pitch transition which is stated to result in a design with a lower profile and economy of manufacture.

In keeping with the trend in the communications industry, it is desirable to provide an electrical connector having IDC's for mass termination and which includes a metal shell for electrical protection and is constructed considering the overall size limitations needed by the industry.

SUMMARY OF THE INVENTION

It is a primary object of the present invention to provide an improved electrical connector having insulation displacement contacts.

It is a further object of the present invention to provide such an electrical connector to have particularly configured contact subassemblies for ease of manufacture.

In accordance with a preferred form of the invention, an electrical connector for insulation displacement connection to conductors of a flat multiconductor cable comprises an elongate insulative housing having two transversely spaced sidewalls and two longitudinally spaced end walls defining a cavity therein. At least one insert subassembly is received in the housing cavity and is latchably secured therein. The subassembly includes an elongate insulative insert supporting a plurality of insulation displacement contacts in longitudinally spaced disposition, each contact including an insulation displacement contact and having two, spaced tines projecting upwardly from the insert. Each pair of tines defines a conductor slot therebetween. Aligned with each insulation displacement contact end is a cable support surface for supporting the multiconductor cable thereon. A recess extends into each cable support surface downwardly spaced from the bottom of the contact slot, each recess extending transversely along the insert and in substantial registry with each slot in the contact end. Between each cable support a groove extends transversely into the insert, each groove having a bottom surface extending downwardly into the insert and spaced from the cable support surface. The surface of each tine includes a cutout therein adjacent each groove.

In a further form of the invention, an insert subassembly for use in the manufacture of the electrical connector is provided. An elongate insulative insert supports a plurality of insulation displacement electrical contacts, each contact being joined by a carrier web. A plurality of grooves extends into the insert of the surface, each groove being in substantial registry with a carrier web joining the contacts.

BRIEF DESCRIPTION OF THE DRAWINGS

FIG. 7(*b*) is a cross-sectional view as seen along viewing lines VII—VII of FIG. 7(*a*).

FIG. 7(*c*) is a view of FIG. 7(*a*) shown subsequent to the removal of the carrier webs.

FIG. 7(*d*) is a view of FIG. 7(*c*) showing in phantom the disposition and support of a flat multiconductor ribbon cable on the insert subassembly subsequent to mass termination to the contacts.

FIG. 8 is a front elevation view partially fragmented to show interior details therein of the securement of the metal shell to the insulative housing.

FIG. 9 is a top plan view of FIG. 8.

DETAILED DESCRIPTION OF THE PREFERRED EMBODIMENTS

Figure 1:
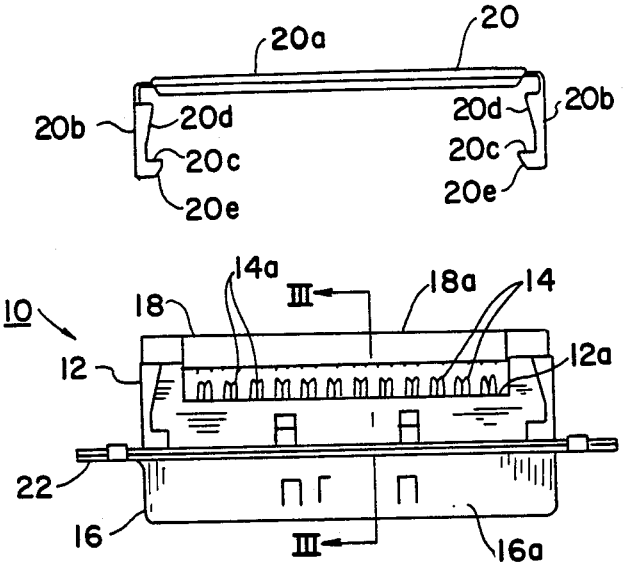
FIG. 1 is an exploded side elevation view of a preferred form of the subject invention which is a metal shell transition 'D' connector having insulation displacement contacts for mass termination to conductors of a flat multiconductor ribbon cable, a cable strain relief being shown in a disassembled state.
Figure 2:
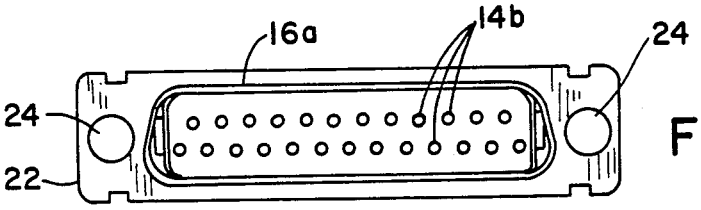
FIG. 2 is a bottom plan view of the connector of FIG. 1 particularly showing the industrial standard D-shape formed by the metal shell.
Figure 3:
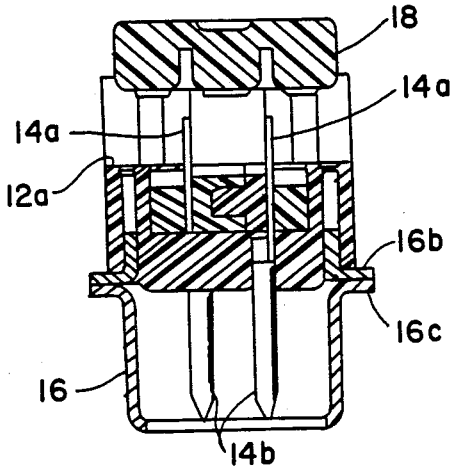
FIG. 3 is an enlarged cross-sectional view of a portion of the electrical connector as seen along viewing lines III—111 of FIG. 1.

Turning now to the drawing figures, in particular FIGS. 1, 2, and 3, a metal shell, pitch transition electrical connector 10 in accordance with a preferred embodiment of the invention is shown. The connector 10 comprises an elongate insulative housing 12 supporting a plurality of insulation displacement contacts (IDC) 14, a metal shell 16 secured to the housing 12, an insulative cover 18 movably attached to the housing 12 and overlying the contacts 14 and a strain relief 20 attachable to the housing 12 and adapted to overlie the cover 18. In the preferred embodiment illustrated, the electrical connector 10 supports twenty-five (25) insulation displacement contacts 14 in two parallel rows, one row comprising thirteen (13) contacts and the other row comprising twelve (12) contacts, as seen in FIG. 2. It should be appreciated, however, that other rows and numbers of contacts may also be used in the contemplated scope of the invention.

Referring still to FIGS. 1 and 2, the contacts 14 in the subject invention have insulation displacement contact ends 14*a* that are positioned in the connector housing 12 to be mass terminated to conductors of a flat, multiconductor ribbon cable (not shown), wherein the conductors are spaced apart at 0.050 inch. The contacts 14 have electrical terminals 14*b* in the form of pins as shown in FIGS. 2 and 3, although socket terminals may also be used, that are positioned in the housing to be intermateable with terminals of an external connector (not shown) that are spaced at 0.0545 inch. As depicted, the IDC ends 14*a* project in an exposed manner upwardly from an upper surface 12*a* of the housing 12 so as to be accessible for mass termination to conductors of a flat multiconductor cable.

The metal shell 16 is spaced downwardly from the IDC ends 14*a* and is supported on the housing 12 adjacent the bottom portion of the connector 10. The metal shell 16 includes a flange 22 extending lengthwise along the connector 10 and projects transversely outwardly from the housing 12. The flange 22 has a pair of mounting apertures 24 located longitudinally externally of the housing 12 for attachment to a suitable panel or the like. The metal shell 16 includes at its lower portion a continuous wall portion 16*a* that surrounds the contacts 14 at the pin ends 14*b* and that, as seen in FIG. 2, defines the industry standard D-shape configuration for polarized attachment to a mateable electrical connector. It should be understood herein that the use of the terms "upper" and "lower" are intended as an aid in describing the preferred embodiment for relative directionality and is not intended to limit the invention being described.

Figure 4:
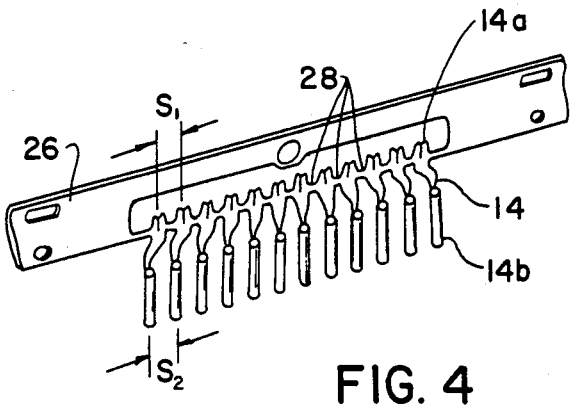
FIG. 4 is a perspective view of an array of insulation displacement contacts formed in accordance with a preferred form of the invention to the desired pitch transition and shown in an interim state wherein the contacts are interconnected on a carrier strip.

Turning now to FIGS. 4, 5, 6 and 7(*a*)–7(*d*), further details of the subject connector are more fully described. In FIG. 4, there is shown an array of twelve (12) contacts 14 as seen during an interim stage of manufacture and which will form one of the rows of contacts 14 in the connector 10. As illustrated, the contacts 14 are stamped in accordance with conventionally known techniques to have the preferred pitch transition. As such, the contacts 14 are stamped in a linear array such that the contact ends 14*a* have a spacing $S_1$ between adjacent ends 14*a* that differs from the spacing $S_2$ extending between adjacent pin ends 14*b*. In the preferred arrangement, the spacing $S_1$ is 0.100 inch while the spacing $S_2$ is 0.109 inch. The contacts 14 during this stage of construction, are supported on a main carrier strip 26 and the IDC ends 14*a* are each interconnected therebetween by a carrier web 28.

Figure 5:
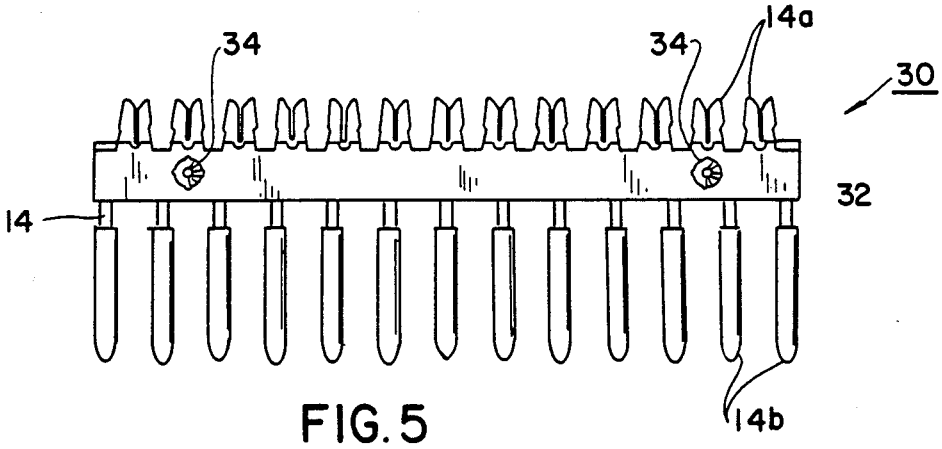
FIG. 5 is a front elevation view of one molded insert subassembly wherein the contacts of FIG. 4 have been separated into individual contacts and supported in an insulative insert.
Figure 6:
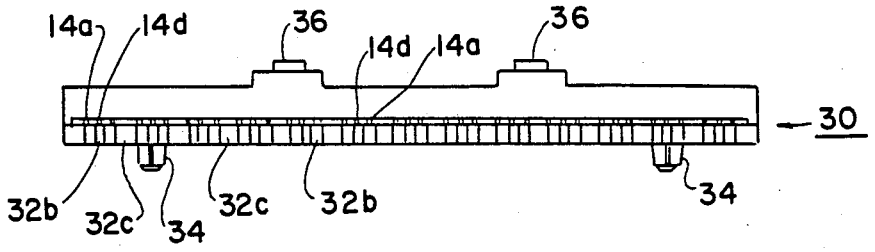
FIG. 6 is a top plan view of the molded insert subassembly of FIG. 5.
Figure 7A:
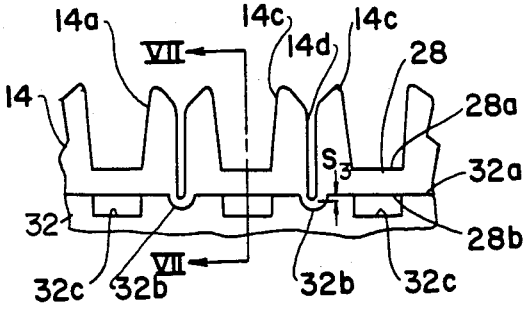
FIG. 7(*a*) is an enlarged view of a portion of the contacts of FIG. 4 shown during an interim stage of manufacture wherein the insulative insert has been molded around the contacts and the carrier webs interconnecting the contacts are still in place.
Figure 7B:
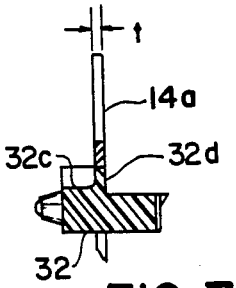
Figure 7C:
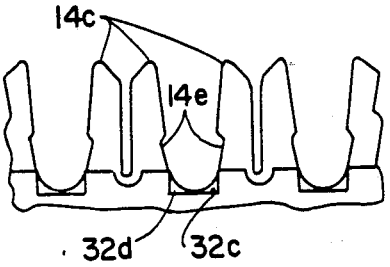
Figure 7D:
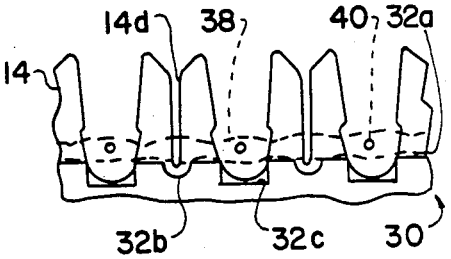

Referring now to FIGS. 5 and 6, a molded insert subassembly 30 comprising an array of contacts formed in accordance with the construction of FIG. 4 is shown. In the subassembly 30 illustrated, the contacts 14 are supported and fully surrounded by an insulative insert 32 that, in accordance with the preferred arrangement of the invention, is injection molded therearound in a suitable manner. The insert 32 is formed to be elongate and support the contacts 14 longitudinally therealong. Formed integrally with the insert 32, the purposes of which will be described hereinafter, are outwardly directed projections 34 and latches 36. In the subassembly 30 the carrier webs 28 (FIG. 4) have been removed resulting thereby in a construction wherein the contacts 14 are independent of, and insulated from, each other along the length of the insert 32. By reference now to FIG. 7(*a*) through FIG. 7(*d*), the manner in which the subassembly 30 is achieved is more fully described.

In FIG. 7(*a*), there is shown a stage of construction wherein the insert 32 has been molded around the contacts 14 and wherein the contacts 14 are still interconnected by the carrier webs 28. The insert 32 is formed around the contacts 14 in a manner wherein the contact ends 14*a* project upwardly above an upper surface 32*a* of the insulative insert 32. Each IDC end 14*a* comprises a pair of pointed, insulation piercing tines 14*c* which define therebetween a slot 14*d* for receiving in electrical engagement therein a conductor of the flat multiconductor ribbon cable to which the contacts 14 are to be interconnected. The carrier webs 28 interconnect the tines 14*c* therebetween, each web 28 extending longtiduinally along the insert 32 and substantially parallel to the upper surface 32*a*.

Still referring to FIG. 7(*a*), the insert 32 is formed to have a recess 32*b* extending downwardly into the upper surface 32*a*, each recess 32*b* being in longitudinal alignment with a respective IDC slot 14*d*. The insert 32 is also formed around the contacts 14 such that the IDC slot 14*d* of each contact extends downwardly toward each recess 32*b* and such that the bottom of the slot 14*d* is downwardly spaced below surface 32*a* a distance $S_3$ as illustrated in FIG. 7(*a*). In the preferred arrangement, the distance $S_3$ is formed to be approximately 0.005 inch.

Referring now to FIG. 7(*a*) and also FIG. 7(*b*), the insert 32 is further formed to have a plurality of grooves 32*c* extending transversely into upper surface 32*a*. Grooves 32*c* are formed in insert 32 to lie in substantial registry with each of the carrier webs 28. In the preferred embodiment, each carrier web 28 has an upper edge 28*a* and a lower edge 28*b*. Edge 28*b* of each carrier web 28 lies in a plane substantially coincident with the upper surface 32*a*, each edge 28*b* being spaced above the bottom wall of each groove 32*c*. During the molding operation of the insert 32 around the contacts 14, there is formed as seen in FIG. 7(*b*), a film 32*d* of insulative material formed integrally with the insert 32. Film 32*d* lies between the bottom edge 28*b* of each carrier web 28 and the bottom surface of each groove 32*c*. The thickness of the film 32*d* is substantially the same as the thickness, t, of the IDC end 14*a* , as depicted in FIG. 7(*b*), the thickness, t, in the preferred embodiment being 0.012 inch.

Referring now to FIG. 7(*c*), a stage of the insert subassembly is shown wherein the carrier webs 28 have been removed. To effect removal of the carrier webs 28, a suitable tool (not shown) is used to sever the carrier webs 28 from the attached tines 14*c* of the contacts. During web removal, the severing tool is passed between adjacent tines 14*c* of each contact and within each groove 32*c*. The severing tool, upon removal of the carrier webs 28, further forms a cutout portion 14*e* in each tine 14*c* adjacent a groove 32*c* and further removes a portion of the film 32*d* of the insert 32. While a small portion of the film 32*d* in each groove 32*c* is removed with the removal of the carrier webs 28, the provision of the grooves 32*c* in registry therewith reduces the need to remove a thicker amount of insulation from the insert 32, thereby advantageously minimizing the wear on the web severing tool.

By reference now to FIG. 7(*d*), the benefits of the construction of the molded insert subassembly 30 can be appreciated. A flat multiconductor ribbon cable 38 is shown in phantom in an interconnected manner with the contacts 14 of the subassembly 30. A plurality of conductors 40 are contained in the insulation of the cable 38. Upon being interconnected to the contacts 14, the cable rests on upper surface 32*a* which provides thereby a cable support surface. The cable conductors 40 respectively reside in the slots 14*d* of the contacts 14 and the cable is supported by surface 32 on both sides of the recess 32*b*. This support coupled with the construction of the slot 14*d* extending below the support surface 32*a*, provides for interconnection of the cable conductors 40 in the slots 14*d* without the conductors 40 striking the bottoms of the slots 14*d*. As such, inadvertent nicking or severing of the conductors during interconnection to the contacts 14 is prevented.

Turning now to FIGS. 8 and 9 and also with further reference to FIG. 3, the details of the securement of the metal shell to the connector housing are more fully described. The connector housing 12 is formed generally elongate having a pair of transversely spaced sidewalls 12*b* and 12*c* and a pair of longitudinally spaced end walls 12*d* and 12*e*. The sidewalls and end walls of the housing 12 form therebetween a cavity 12*f* for receipt of the molded insert subassemblies as will be described hereinbelow. The sidewalls 12*b* and 12*c* further define upper surface 12*a* of the housing from which the insulation displacement contacts 14 project for electrical interconnection with conductors of a flat multiconductor ribbon cable. A plurality of apertures 12*g* a bottom wall 12*h* of the housing, each aperture 12*g* extend through communicating with the cavity 12*f* and being positioned to receive therein a contact pin end 14*b* of each contact 14. Extending transversely through each of the sidewalls 12*b* and 12*c* are latching openings 12*i* adapted to latchingly engage the latches 36 of the insert subassemblies as will be described.

Extending longitudinally in each sidewalls 12*b* and 12*c* are three pockets 12*j*, the upper portion of each pocket 12*j* extending through surface 12*a* and being of greater dimension than an opening 12*k* defining the lower portion of each pocket 12*j*. Each pocket 12*j* is further defined by a pair of spaced obliquely inclined interior surfaces 12L which provide cooperating locking surfaces for securement of the metal shell 16 as will be described.

The metal shell 16, as seen particularly in FIGS. 8 and 3, is constructed in accordance with the preferred arrangement of the invention in two portions, a top portion 16*b* and a bottom portion 16*c*. Top portion 16*b* includes a horizontally extending flange portion 22*a* and integrally thereon and projecting upwardly therefrom six locking elements 42 arranged in two substantially parallel, transversely spaced rows. Each locking element 42 is positioned to be in registry with a pocket 12*j* of the housing 12. Each locking element 42 includes a pair of spaced deformable prongs 42*a*. The locking elements 42 are adapted to be received in the respective openings 12*k* of the housing pockets and with suitable tooling (not shown) that access the locking elements in the pockets through the upper housing surface 12*a*, the prongs 42*a*are respectively deformed outwardly against inclined surfaces 12L such that the prongs are spaced dimensionally greater than the opening 12*k* to thereby lock the locking elements and the top metal portion 16*b* fixedly to the housing 12.

Referring still to FIG. 8, bottom metal shell portion 16*c* comprises the wall portion 16*a* defining the D-shape configuration, bottom portion 16*c* further including a flange portion 22*b* extending longitudinally and from which the wall portion 16*a* projects downwardly therefrom. Bottom portion 16*c* further includes integrally thereon a plurality of deformable tabs 44 that project upwardly from the flange portion 22*b* and which tabs 44 are adapted to engage the upper flange portion 22*a* to thereby mechanically secure the metal shell top portion 16*b* and metal shell bottom portion 16*c* in secured relation. As so joined, the flange portions 22*a* and 22*b* define the connector flange 22 as illustrated in FIG. 1.

It should be appreciated that by the use of the locking element 42 and interior pockets 12*j* whereby the metal shell 16 is secured internally of the housing 12, the need for external housing support structure is minimized thereby permitting a reduction in the size of the subject connector.

Turning now to FIGS. 1 and 8, the details of the strain relief of the present invention are described. The strain relief 20 in the preferred construction is formed of metal, for example, stainless steel and includes a substantially planar, elongate portion 22*a* that is adapted to overlie the cover 18 of the subject connector. Depending downwardly therefrom at the longitudinal ends of the strain relief 20, there are locking legs 20*b*. Each leg 20*b* includes a locking portion defined by the longitudinally extending surface 20*c* and an inclined surface 20*d*. At the lower extent of each locking portion 20*b*, there is a chamfered surface 20*e* that is formed at an oblique angle relative to the longitudinal direction of the surface 20*c*.

Within the front surface of each outer side wall 12*b* and 12*c* as illustrated in FIG. 8, there are formed adjacent the end walls 12*d* and 12*e*, cooperative locking portions for engagement with the legs 20*b* of the strain relief 20. The housing locking portions are defined by a longitudinally extending surface 12*m* and an inclined surface 12*n* formed into the housing sidewalls in a configuration complementary to the locking surfaces in the strain relief legs 20*b*. In assembling the strain relief to the housing 12, the chamfered surfaces 20*e* engage the inclined surfaces 12*n* of the housing initially causing the legs 20*b* to longitudinally flex outwardly during assembly. The strain relief 20 is then further moved downwardly onto the housing until the longitudinal surfaces 20*c* of each leg 20*b* snap into engagement with the longitudinal surfaces 12*m* on the housing to thereby lock the strain relief thereon. Construction of the strain relief and the locking portions of the housing to be on the side exterior surfaces permits the connector to be constructed to a minimal longitudinal dimension as desired.

Figure 10:
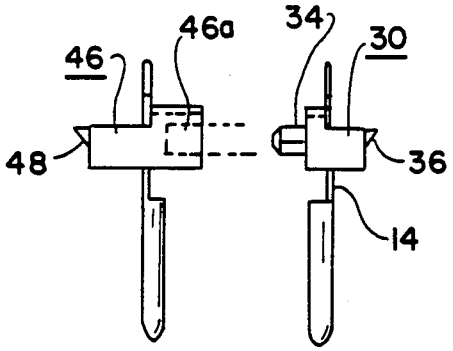
FIG. 10 is an exploded side elevation view showing the molded insert subassembly of FIG. 5 ready for joining to a second molded insert subassembly formed in a similar manner.
Figure 11:
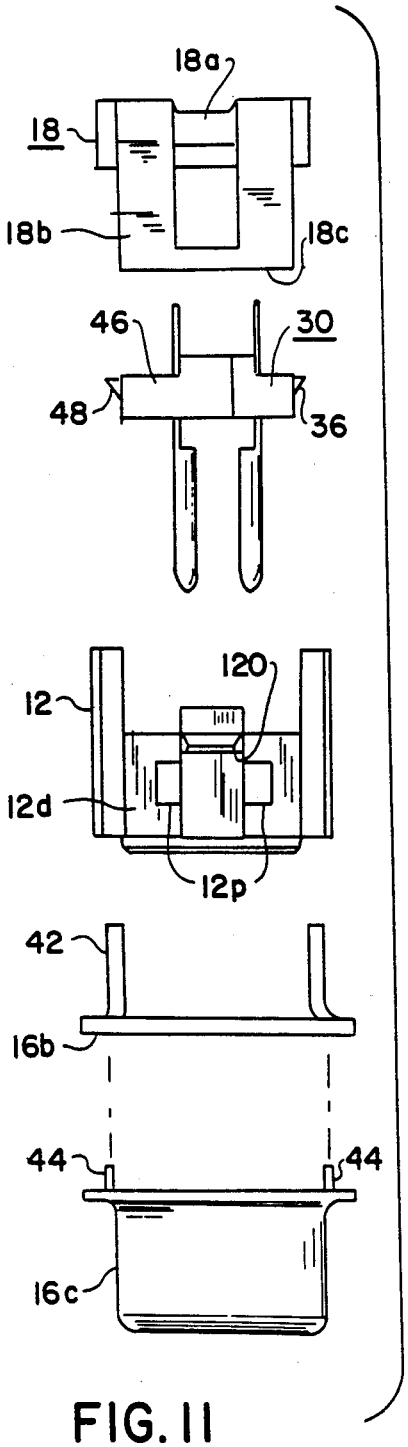
FIG. 11 is an exploded side elevation view showing schematically the various components of the electrical connector of the preferred embodiment of the invention and the assembly process.

Turning now to FIGS. 10 and 11, the assembly of the preferred embodiment of the subject electrical connector is set forth. The metal shell bottom portion 16*c* is attached to the metal shell top portion 16*b* by the deformable tabs 44. The composite shell portions fixedly secured are then secured to the housing 12 by the locking elements 42 being internally attached to the housing 12 as previously described. By reference specifically to FIG. 10, the molded insert subassembly 30 is joined to a similarly formed molded insert subassembly 46. While subassembly 30 supports a row of thirteen (13) contacts, subassembly 46 supports a row of twelve (12) contacts. The subassembly 46 further includes a plurality of spaced sockets 46*a* that are particularly configured to receive the projections 34 of subassembly 30. Similar to subassembly 30, subassembly 46 also includes latches 48 projecting outwardly therefrom. The joined subassemblies 30 and 46, as illustrated in FIG. 11, are then together inserted into the cavity 12*f* of the housing 12 and the latches 36 and 48 are suitably engaged in the openings 12*i* in the sidewalls 12*b* and 12*c* respectively of the housing 12, thereby securing the subassemblies 30 and 46 relative to the housing 12. The elongate connector cover 18, which has a longitudinally extending portion 18*a* and two downwardly spaced depending legs 18*b* at the longitudinal ends thereof, is secured to the housing end walls 12*d* and 12*e* by a horizontally extending latching member 18*c* that engages a first latch 12*o* provided on the respective end walls 12*d* and 12*e*. In this position, the cover is in a precrimped condition which is depicted in FIG. 1 whereby a flat multiconductor ribbon cable may be inserted between the planar cover portion 18*a* and the insulation displacement contacts preliminary to mass termination. The housing further includes on its end walls 12*d* and 12*e* a second latch defined by ledges 12*p* that engage the cover latching member 18*c* subsequent to moving the cover downwardly against a flat multiconductor ribbon cable to effect mass termination. In this crimped position, the cover 18 is thus locked relative to the housing by the ledges 12*p*. Following mass termination of a flat multiconductor ribbon cable in this manner, the cable is typically folded back over the connector such that the outer insulation of the cable resides on the top surface of the cover 18. The strain relief is then attached to the housing in a manner described hereinabove such that the flat multiconductor cable is pressed between the planar portion 20*a* of the strain relief and the planar portion 18*a* of the connector cover 18. So assembled, the height of the connector from the bottom of the metal shell portion 16*a* to the top of the strain relief is on the order of 0.73 inch.

Having described the preferred embodiments of the invention herein, it should be appreciated that variations may be made thereto without departing from the contemplated scope of the invention. Accordingly, the preferred embodiment is intended to be illustrative rather than limiting. The true scope of the invention is set forth in the claims appended hereto.

We claim:

1. An electrical connector for insulation displacement connection to conductors of a flat multiconductor cable comprising an elongate insulative housing having two transversely spaced side walls and two longitudinally spaced end walls defining a cavity therein, at least one insert subassembly received in said housing cavity and latchably secured therein, said subasembly including an elongate insulative insert supporting a plurality of insulation displacement contacts in longitudinally spaced disposition, each contact including an insulation displacement contact end having two, spaced tines projecting upwardly from said insert, said tines defining a conductor slot therebetween, there being aligned with each insulation displacement contact end a cable support surface for supporting said multiconductor cable, a recess extending into each cable support surface and downwardly spaced from the bottom of the slot in each insulation displacement contact end, each recess extending transversely along said insert and in substantial registry with each slot in the contact end, there being longitudinally between each cable support surface a groove extending transversely along said insert, each groove having a bottom surface extending downwardly into said insert and spaced from the cable support surfaces, an outer surface of each tine having a cutout therein adjacent each groove.

2. An electrical connector according to claim 1, wherein the bottom of the slot in each insulation displacement contact end extends relatively below the respective cable support aligned therewith.

3. An electrical connector according to claim 2, wherein said insert comprises insulative material surrounding said contacts.

4. An electrical connector according to claim 3, wherein said insulative material is injection molded around said contacts.

5. An electrical connector according to claim 2, wherein said housing supports two such insert subassemblies in said cavity.

6. An electrical connector according to claim 2, wherein said housing supports a metal shell thereon, a portion of said metal shell surrounding said contacts.

7. An electrical connector according to claim 6, wherein said metal shell includes a locking element received interiorly of said housing for securing said metal shell thereto.

8. An insert subassembly for use in the manufacture of an electrical connector of the type for mass termination to conductors of a flat multiconductor cable, comprising:

a plurality of insulation displacement electrical contacts each having insulation displacement ends and terminal ends each said insulation displacement end having two, spaced tines defining a conductor receiving slot, each contact being joined between adjacent tines by a carrier web, to thereby form a joined array of contacts, an elongate insulative insert supporting said contacts, said insert having an upper surface defining a cable support surface from which said contact ends project, and a plurality of grooves extending into said insert upper surface, each groove being in substantial registry with a carrier web joining said tines, said grooves each having a bottom surface spaced from each carrier web.

9. An insert subassembly according to claim 8, wherein said insulative insert is molded around said contacts, said insert having a transverse extent greater than the thickness of said contact ends.

10. An insert subassembly according to claim 9, wherein a film of insulative material extends in each groove between the bottom surface of each groove and each carrier web.

11. An insert subassembly according to claim 10, wherein said cable support surface has therein a plurality of recesses along said insert, each recess extending transversely into said cable support surface and in substantial registry with a slot of each insulation displacement contact end.

12. An insert subassembly according to claim 11, wherein the slot of each insulation displacement contact end extends downwardly toward each said recess, a bottom surface of each slot extending spacedly below said cable support surface.

13. An insert subassembly according to claim 10, wherein each carrier web extends longitudinally relative to said insert and substantially parallel to said carrier support surface.

* * * * *